US006970819B1

(12) United States Patent
Tabei

(10) Patent No.: US 6,970,819 B1
(45) Date of Patent: Nov. 29, 2005

(54) SPEECH SYNTHESIS DEVICE

(75) Inventor: Yukio Tabei, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 1035 days.

(21) Appl. No.: 09/697,122

(22) Filed: Oct. 27, 2000

(30) Foreign Application Priority Data

Mar. 17, 2000 (JP) ..... 2000-075831

(51) Int. Cl.[7] ..... G10L 15/14
(52) U.S. Cl. ..... 704/256; 704/258; 704/268; 704/205; 704/206; 704/257; 704/208
(58) Field of Search ..... 704/258, 256, 704/208, 205, 206, 257, 268, 267, 269

(56) References Cited

U.S. PATENT DOCUMENTS 5,682,501 A * 10/1997 Sharman ..... 704/260
5,740,320 A * 4/1998 Itoh ..... 704/267
5,864,812 A * 1/1999 Kamai et al. ..... 704/268
5,940,797 A * 8/1999 Abe ..... 704/260
6,006,175 A * 12/1999 Holzrichter ..... 704/208
6,665,641 B1 * 12/2003 Coorman et al. ..... 704/260

FOREIGN PATENT DOCUMENTS

JP 63-46498 2/1988
JP 04134499 5/1992

* cited by examiner

*Primary Examiner*—Vijay B. Chawan
(74) *Attorney, Agent, or Firm*—Volentine Francos & Whitt, PLLC

(57) ABSTRACT

The principal object of this invention is to provide a suitable control method for closing length with respect to phonemes (such as unvoiced plosive consonants) having a closing interval, and as a result an improved rule-based speech synthesis device is provided. A phoneme type judgement part 201 judges whether the phoneme in question is a vowel or consonant and, in the case of a consonant, judges whether or not it is a consonant that anteriorly has a closing interval. As a result, it operates a vowel length estimation part 202 when it judges that the phoneme is a vowel and operates a consonant length estimation part 205 when it judges that the phoneme is a consonant, and when it has judged that this phoneme anteriorly has a closing interval, it operates a closing length estimation part 208, whereby the respective time lengths are estimated. After that, the estimated time lengths are set by vowel length setting part 203, consonant length setting part 206 and closing length setting part 209, respectively.

5 Claims, 9 Drawing Sheets

FIG. 6

| Number | Type Name | Phoneme Symbol |
|---|---|---|
| 1 | Unvoiced Plosive Consonant | / p,t,k / |
| 2 | Some Palatalized Sound | / py,ky,cy, / |
| 3 | Others | / ts,ch / |

SPEECH SYNTHESIS DEVICE

BACKGROUND OF THE INVENTION

1. Field of the Invention

This invention relates to a rule-based speech synthesis device that synthesizes speech, and more particularly to a rule-based speech synthesis device that synthesizes speech from an arbitrary vocabulary.

2. Description of Related Art

Text-to-speech conversion (the conversion of a text document into audible speech) has hitherto been configured from a text analysis part and a rule-based speech synthesis part (parameter generation part and waveform synthesis part).

Text containing a mixture of kanji and kana characters (a Japanese-language text document) is input to the text analysis part, where this document is subjected to morphological analysis by referring to a word dictionary, the pronunciation, accentuation and intonation of each morpheme are analyzed (if necessary, syntactic and semantic analysis and the like are also performed), and then phonological symbols (intermediate language) with associated prosodic symbols are output for each morpheme.

In the parameter generation part, prosodic parameters such as pitch frequency patterns, phoneme duration times, pauses and amplitudes are set for each morpheme.

In the waveform synthesis part, speech synthesis units in the target phoneme sequence (intermediate language) are selected from previously stored speech data, and waveform synthesis processing is performed by concatenating/modifying the reference data of these speech synthesis units according to the parameters determined in the parameter generation part. The type of speech synthesis units that have been tried out is phonemes, syllables (CV), and VCV/CVC (C=consonant, V=vowel). Although phonemes have the least number of possible representations, it is essential to incorporate rules for coarticulation, which is not easy to do. Consequently, the resulting synthesized speech has had poor quality, and phonemes are now seldom used as speech synthesis units. On the other hand, CV, VCV and CVC units include coarticulation within each unit. For example, since a VCV type comprises a consonant between two vowels, the consonant part is very clear. And since a CVC type is concatenated with consonants which have small amplitude, the concatenation distortion is small. Recently, units consisting of even larger phonetic chain have also been partially used as speech synthesis units.

As the speech data in the speech synthesis units, a method has come to be used whereby original audio waveforms are used unaltered, and based on this, high quality synthesized sound is obtained with little degradation of quality.

To obtain more natural-sounding synthesized speech with the abovementioned conventional text-to-speech conversion, the way in which the parameters in the abovementioned parameter generation part (pitch frequency pattern, phoneme duration time, pauses, amplitude) are appropriately controlled to approximate natural speech while considering the type of speech synthesis units, the speech segment quality and the synthesis procedure is of great importance.

Of these parameters, methods for controlling the phoneme duration time in particular have hitherto been described in Reference 1 (Japanese Patent Application Laid-Open No. S63-46498) and Reference 2 (Japanese Patent Application Laid-Open No. H4-134499).

The techniques described in the abovementioned References 1 and 2 are methods which use a statistical model (Hayashi's first method of quantification model) to obtain control rules by analyzing a large amount of data. As is well known, a Hayashi's first method of quantification is one of multivariate analysis technique wherein the target external criterion (phoneme duration time) is calculated based on qualitative factors, and is formulated as shown in Formulae (1) through (3) below.

That is, if j is the ith data element item, k is the category to which it belongs, and x(jk) is the category quantity thereof (the coefficient associated with the category), then the estimated values y(i) are given by Formula (1).

$$y(i) = \sum_j \sum_k \times(jk)\delta(jk) \tag{1}$$

where:

$$\delta(jk) = 1(\text{when data } i \text{ corresponds to category } k \text{ of item } j) \tag{2}$$
$$= 0(\text{otherwise})$$

x(jk) is determined by the method of least square. That is, it is determined by minimizing the squared error between the estimated values y(i) and the actual measured values Y(i).

$$\sum_i \{y(i) - Y(i)\}^2 \rightarrow \text{minimum} \tag{3}$$

The equation has to be solved by partially differentiating Formula (3) by x(jk). When a computer is used to perform real calculations based on Formula (3), it results in a numerical analysis problem to solve simultaneous equations.

In the abovementioned conventional phoneme duration time controling method, categorization into Hayashi's first method of quantification form does not always work well, making it impossible to achieve adequate estimation precision. Also, these conventional methods make no mention of methods for setting the closing length in phonemes having a closing interval (such as unvoiced plosive consonants). Accordingly, there have hitherto been no methods for appropriately controlling the closing interval length, which is of great perceptual importance.

The principal object of the present invention is to provide a rule-based speech synthesis device that can estimate phoneme duration times more accurately and has smaller estimation errors and better control functions, and in particular it aims to provide a suitable closing time length control method for phonemes having a closing interval (such as unvoiced plosive consonants), and as a result, an object of the present invention is to provide a rule-based speech synthesis device with improved quality.

SUMMARY OF THE INVENTION

Consequently, the rule-based speech synthesis device of the present invention is a rule-based speech synthesis device that generates arbitrary speech by selecting previously stored speech synthesis units, concatenating these selected speech synthesis units, and controlling the prosodic information, and which is provided with a phoneme duration time setting means that estimates and controls the closing interval length of phonemes having a closing interval separately from the vowel length and the consonant length.

BRIEF DESCRIPTION OF THE DRAWINGS

The foregoing and other objects, features and advantages of the present invention will be better understood from following description taken in connection with accompanying drawings, in which:

FIG. 6 shows the classes of consonants prefixed by a closing length;

DESCRIPTION OF THE PREFERRED EMBODIMENTS

Embodiments of the present invention will be described in detail below with reference to the figures.

Basic Configuration of the Speech Synthesis Device

Figure 1:
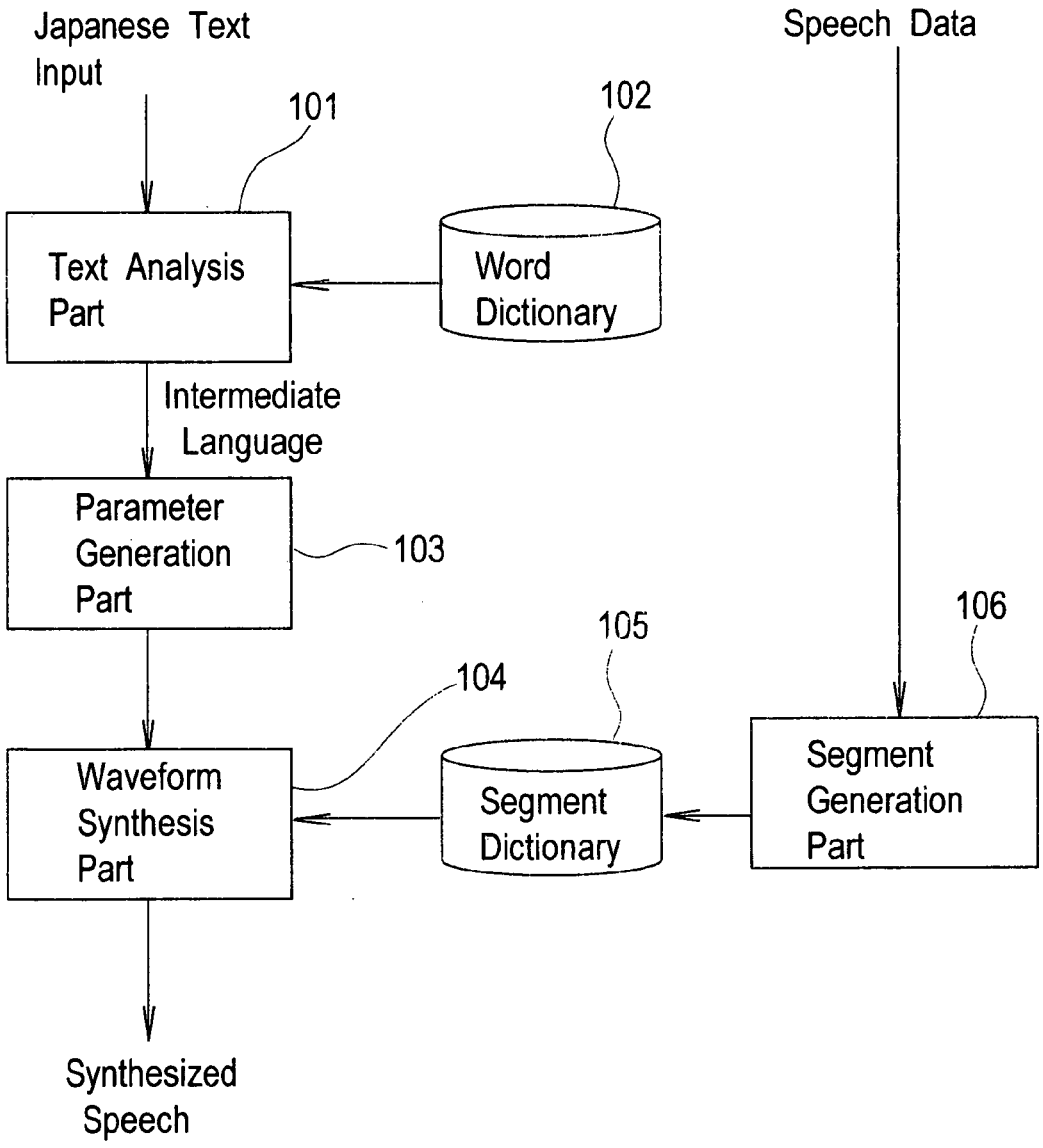
FIG. 1 is a block diagram showing one embodiment of a speech synthesis device (text-to-speech conversion device) relating to this invention.

FIG. 1 shows the configuration of a speech synthesis device (text-to-speech conversion device) relating to an embodiment of this invention. Text containing a mixture of kanji and kana characters (referred to as a Japanese-language text document) is input to text analysis part 101, where this input document is subjected to morphological analysis by referring to a word dictionary 102, the pronunciation, accentuation and intonation of each morpheme obtained by this analysis are analyzed, and then phonological symbols (intermediate language) with associated prosodic symbols are output for each morpheme.

In parameter generation part 103, based on the intermediate language itself, the segment address to be used is selected from within a segment dictionary 105, and parameters such as the pitch frequency pattern, phoneme duration time and amplitude are set.

Segment dictionary 105 is produced beforehand by segment generation part 106 after inputting speech signals to segment generation part 106.

In segment generation part 106, before synthesizing speech, segments are produced beforehand from the speech data, on a base of which segments synthesized sound will be generated.

Waveform synthesis part 104 can apply various conventional methods as the waveform synthesis method; for example, it might use a pitch synchronous overlap add (PSOLA) method. Note that rule-based speech synthesis is the synthesis of speech from an input consisting of phonological symbols with associated prosodic symbols (intermediate language).

The phoneme duration time determined in parameter generation part 103 mainly regulates the phoneme duration time by extending or contracting the vowel parts based on the isochrony of the Japanese language. Specifically, processing is performed whereby either the tail end segment is used repeatedly (extension) when the determined phoneme duration time is longer than the segment, or is cut off mid-way (contraction) when the determined phoneme duration time is shorter.

Note that in FIG. 1, text analysis part 101, word dictionary 102, waveform synthesis part 104, segment dictionary 105 and segment generation part 106 can be configured using conventional techniques.

First Embodiment of Method for Setting the Phoneme Duration Time in the Parameter Generation Part A first embodiment of a method for setting the phoneme duration time in parameter generation part 103 will be described in detail with reference to FIG. 2.

Figure 2:
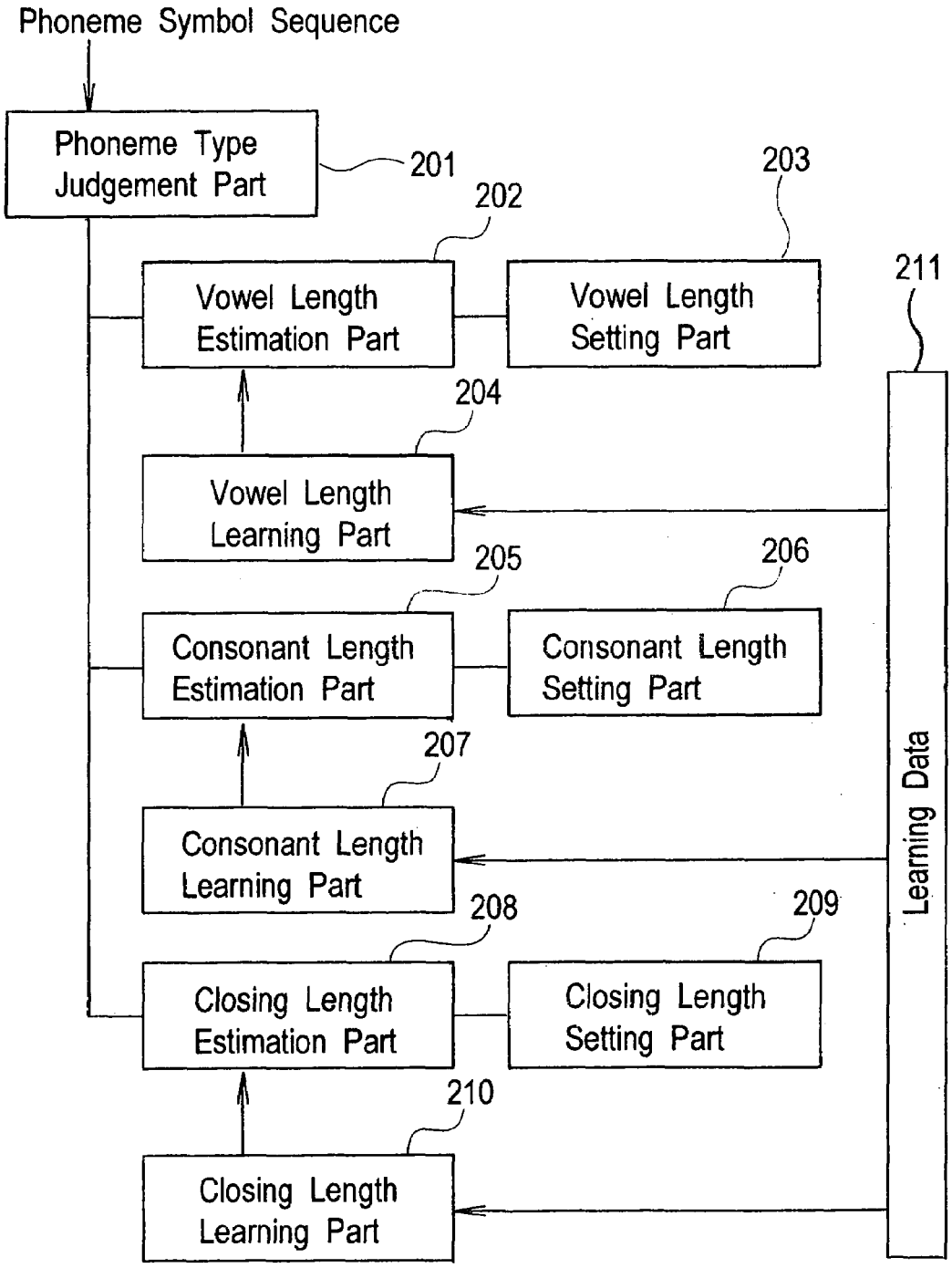
FIG. 2 shows the configuration of the phoneme duration time setting part in a first embodiment of this invention.

In FIG. 2, a phoneme symbol sequence is input to a phoneme type judgement part 201, which judges whether the phoneme in question is a vowel or consonant and, in the case of a consonant, judges whether or not it is a consonant anteriorly having a closing interval (/p, t, k/ etc.; see FIG. 6). As a result, it operates a vowel length estimation part 202 when it judges that the phoneme is a vowel, and when it judges that the phoneme is a consonant, it either operates a consonant length estimation part 205 or, when it has judged that this phoneme anteriorly has a closing interval (such as /p, t, k/), it operates a closing length estimation part 208, whereby the respective time lengths are estimated. After that, the estimated time lengths are set by vowel length setting part 203, consonant length setting part 206 and closing length setting part 209, respectively. The consonant length setting is performed in the following temporal order: estimated closing length, followed by estimated consonant length. Note that as a result of our analyzing real speech data, it has been found that the types of consonants that anteriorly have a closing length are only the phonemes shown in FIG. 6, and accordingly nasal and the like are not included.

Note that a Hayashi's first method of quantification can, for example, be used to estimate the temporal length. In this method, learning data 211 is used beforehand to learn each of the models in vowel length learning part 204, consonant length learning part 207 and closing length learning part 210 (corresponding to solving simultaneous equations on a basis such as the abovementioned equation (3)), and the weighting coefficients necessary for estimation are determined as a result of this learning. The weighting coefficient means x(jk) on the abovementioned equation (1).

As described above, the phoneme duration time setting method of the present embodiment makes it possible to control the appropriate phoneme duration time with respect to phonemes anteriorly having a closing interval, and accordingly it is possible to obtain a highly natural synthesized sound in a rule-based speech synthesis device.

Note that the present embodiment employs a configuration wherein a Hayashi's first method of quantification is used for learning and estimation, but is not limited thereto, and other statistical methods may also be used.

Second Embodiment of Method for Setting the Phoneme Duration Time in the Parameter Generation Part A second embodiment of a method for setting the phoneme duration time in parameter generation part 103 will be described in detail with reference to FIG. 3.

Figure 3:
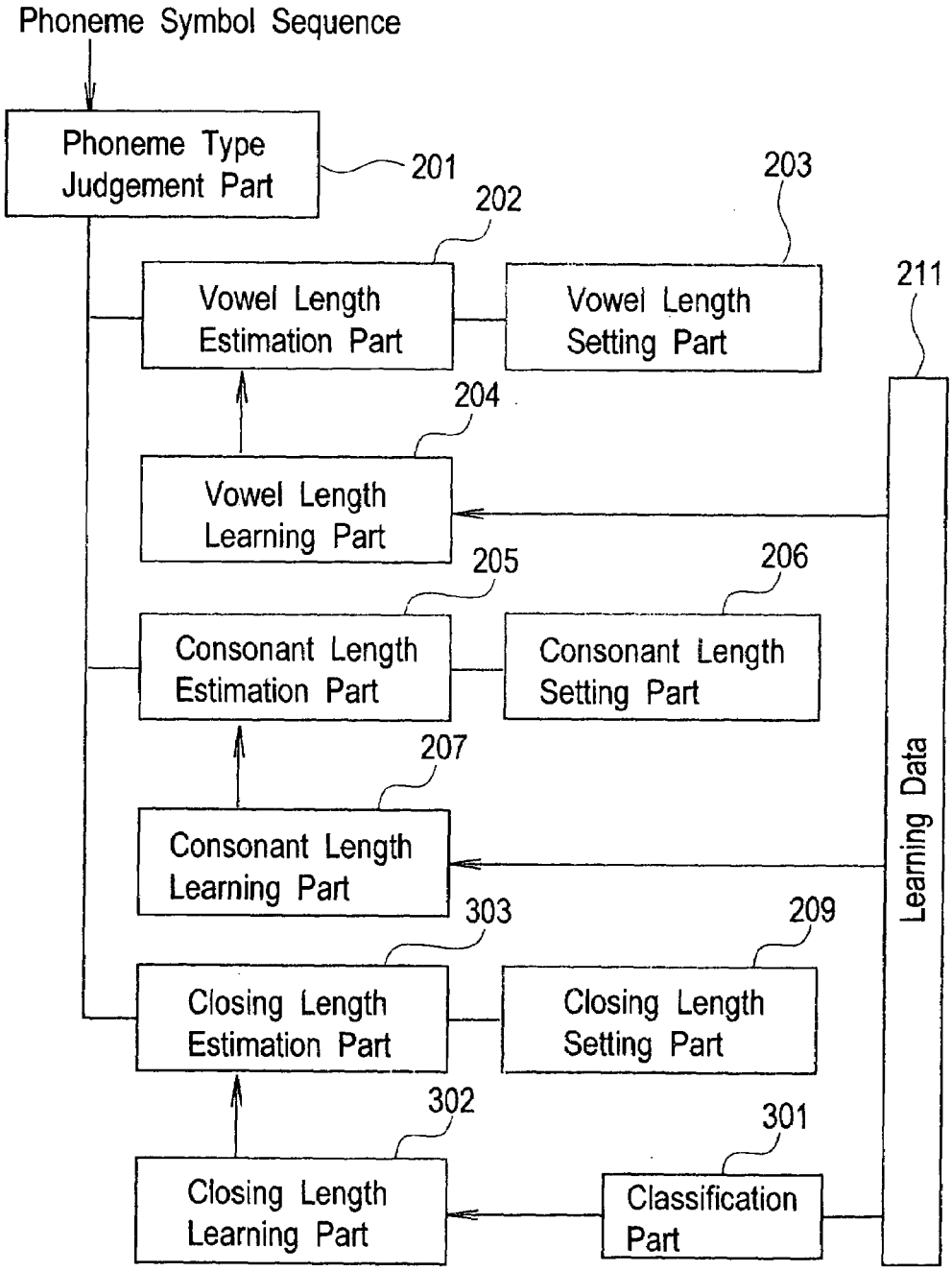
FIG. 3 shows the configuration of the phoneme duration time setting part in a second embodiment of this invention.

The configuration shown in FIG. 3 differs from that of the first embodiment in that a closing length classification part 301 is provided, and in that closing length learning part 302 and closing length estimation part 303 operate differently; parts that operate in the same way as in the first embodiment are given the same numbers as in FIG. 2. The operation of this embodiment is described below.

First, a phoneme symbol sequence is input to phoneme type judgement part 201, and this judgement part 201 judges whether the phoneme in question is a vowel or consonant and, in the case of a consonant, judges whether or not it is a consonant that anteriorly has a closing interval. As a result, it operates a vowel length estimation part 202 when it judges that the phoneme is a vowel, and when it judges that the phoneme is a consonant, it either operates a consonant length estimation part 205 or, when it has judged that this phoneme anteriorly has a closing interval, it operates a closing length estimation part 303, whereby the respective time lengths are estimated. After that, the estimated time lengths are set by vowel length setting part 203, consonant length setting part 206 and closing length setting part 209, respectively. The consonant length setting is performed in the following temporal order: estimated closing length, followed by estimated consonant length.

Hayashi's first method of quantification is used to estimate the temporal length. However, in the second embodiment, the method whereby a Hayashi's first method of quantification is used to learn/estimate the closing length differs from that of the first embodiment. Specifically, in FIG. 3, learning data 211 is classified beforehand by a closing length classification part 301, each model of closing length learning part 302 is learned, and the weighting coefficients necessary for estimation are determined beforehand.

Since the Hayashi's first method of quantification performs modeling by a linear weighted sum of only the number of category numbers, the estimation precision is determined by the reliability of the learning data. Also, although the factors used in this modeling include the phoneme in question, the environment of the two phonemes before and after it and the position of the phoneme, these factors generally take the form of qualitative data and are not arranged in order of magnitude. Consequently, there is no way in which the factors can be essentially grouped.

In the second embodiment, closing length classification part 301, closing length learning part 302 and closing length estimation part 303 are provided to solve this problem and characterize this embodiment, and the operation thereof is described with reference to FIG. 7.

Figure 7:
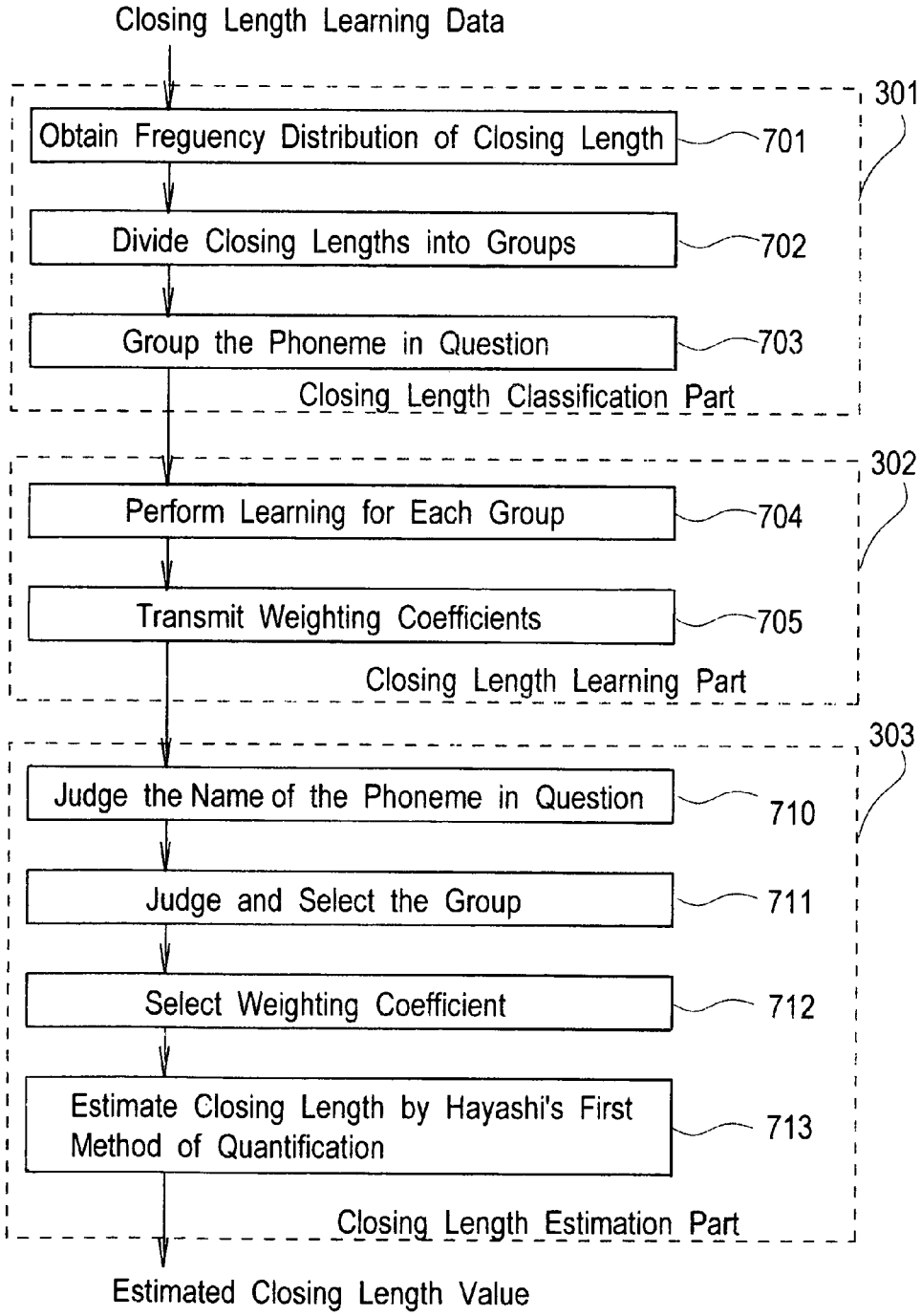
FIG. 7 illustrates the operation of the closing length classification part, the closing length learning part and the closing length estimation part in the second embodiment of this invention.

In FIG. 7, the frequency distribution of an external criterion (closing length) of the learning data is determined at step 701 in closing length classification part 301. At step 702, based on the frequency distribution, the closing lengths are divided into some groups. Furthermore, at step 703 the correspondence with the phoneme in question is obtained, and this phoneme is also divided into groups.

In closing length learning part 302, learning is performed for each of the abovementioned groups at step 704 and the weighting coefficients are determined, and as a result the weighting coefficients are transmitted to closing length estimation part 303 at step 705.

Next, estimation is performed. In closing length estimation part 303, the name of the phoneme in question is judged based on the input phoneme symbol sequence at step 710, said group is selected based on the name of the phoneme in question at step 711, the weighting coefficients inherent to said group are selected at step 712, and said weighting coefficients are used to estimate the closing length by a Hayashi's first method of quantification at step 713.

As described above, with the phoneme time length setting method of the present embodiment, by classifying the closing lengths into groups as described above, it is possible to obtain a desirable distribution of the closing lengths that actually appear. As a result, learning can be achieved with greater precision than in conventional methods and the distribution of estimated values can be kept small in the estimations, which has the advantage of improving the estimation precision.

Third Embodiment of Method for Setting the Phoneme Duration Time in the Parameter Generation Part A third embodiment of a method for setting the phoneme duration time in parameter generation part 103 is described in detail with reference to FIG. 4.

Figure 4:
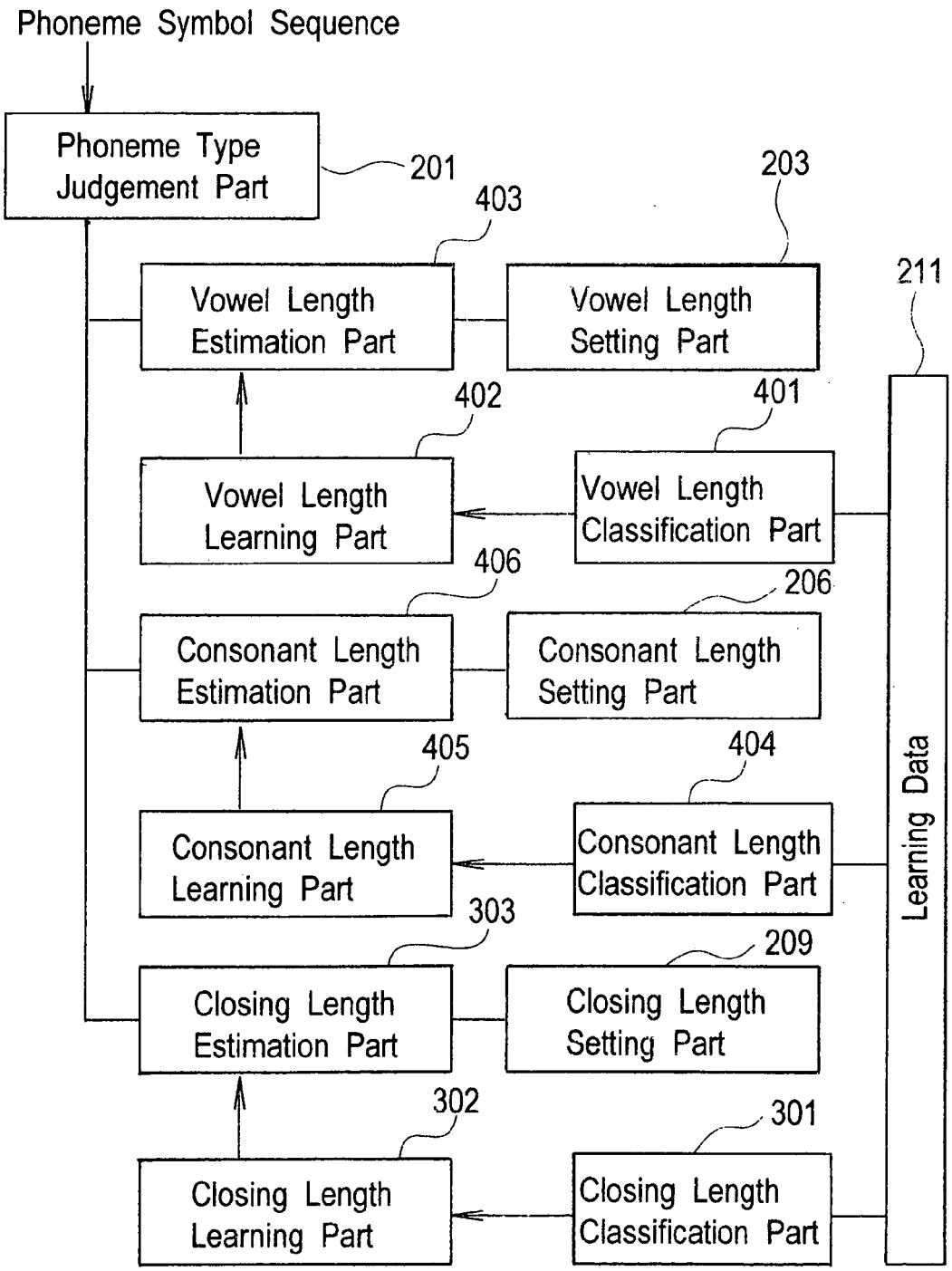
FIG. 4 shows the configuration of the phoneme duration time setting part in a third embodiment of this invention.

The configuration shown in FIG. 4 differs from that of the second embodiment in that a vowel length classification part 401 and a consonant length classification part 404 are provided, and in that vowel length learning part 402, vowel length estimation part 403, consonant length learning part 405 and consonant length estimation part 406 operate differently; parts that operate in the same way as in the second embodiment are given the same numbers as in FIG. 3. The operation of this embodiment is described below.

First, a phoneme symbol sequence is input to phoneme type judgement part 201, and this judgement part 201 judges whether the phoneme in question is a vowel or consonant and, in the case of a consonant, judges whether or not it is a consonant that anteriorly has a closing interval. As a result, it either operates vowel length estimation part 403 when it judges that the phoneme is a vowel, or it operates consonant length estimation part 406 when it judges that the phoneme is a consonant, or it operates closing length estimation part 303 when it judges that this phoneme anteriorly has a closing interval, whereby the respective time lengths are estimated. After that, the estimated time lengths are set respectively by vowel length setting part 203, consonant length setting part 206 and closing length setting part 209. The consonant length setting is performed in the following temporal order: estimated closing length, followed by estimated consonant length.

In FIG. 4, the vowel length learning data in the previously learning data 211 is classified by a vowel length classification part 401, and the consonant length learning data is classified by a consonant length classification part 404. As for the closing length, the closing length learning data is classified by closing length classification part 301, and since closing length learning part 302 and closing length estimation part 303 are operated in the same way as in the second embodiment, their description is omitted here.

The factors of Hayashi's first method of quantification take the form of qualitative data and are not arranged in order of magnitude. Consequently, there is no way in which the factors can be essentially grouped. The third embodiment, like the second embodiment, aims to improve on this, and in particular it aims to improve the estimation precision of vowel length and consonant length.

Figure 8:
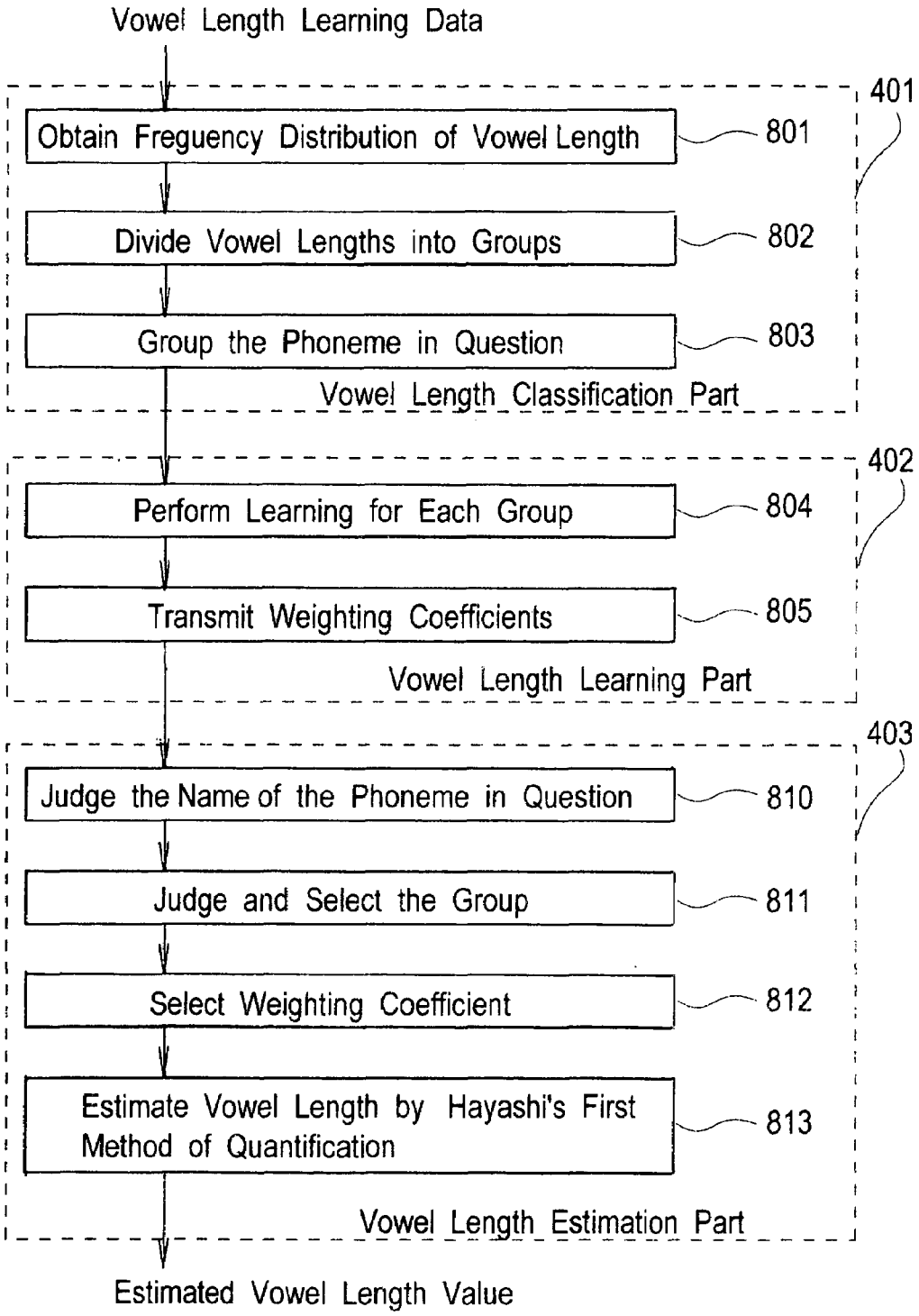
FIG. 8 illustrates the operation of the vowel length classification part, the vowel length learning part and the vowel length estimation part in the third embodiment of this invention.
Figure 9:
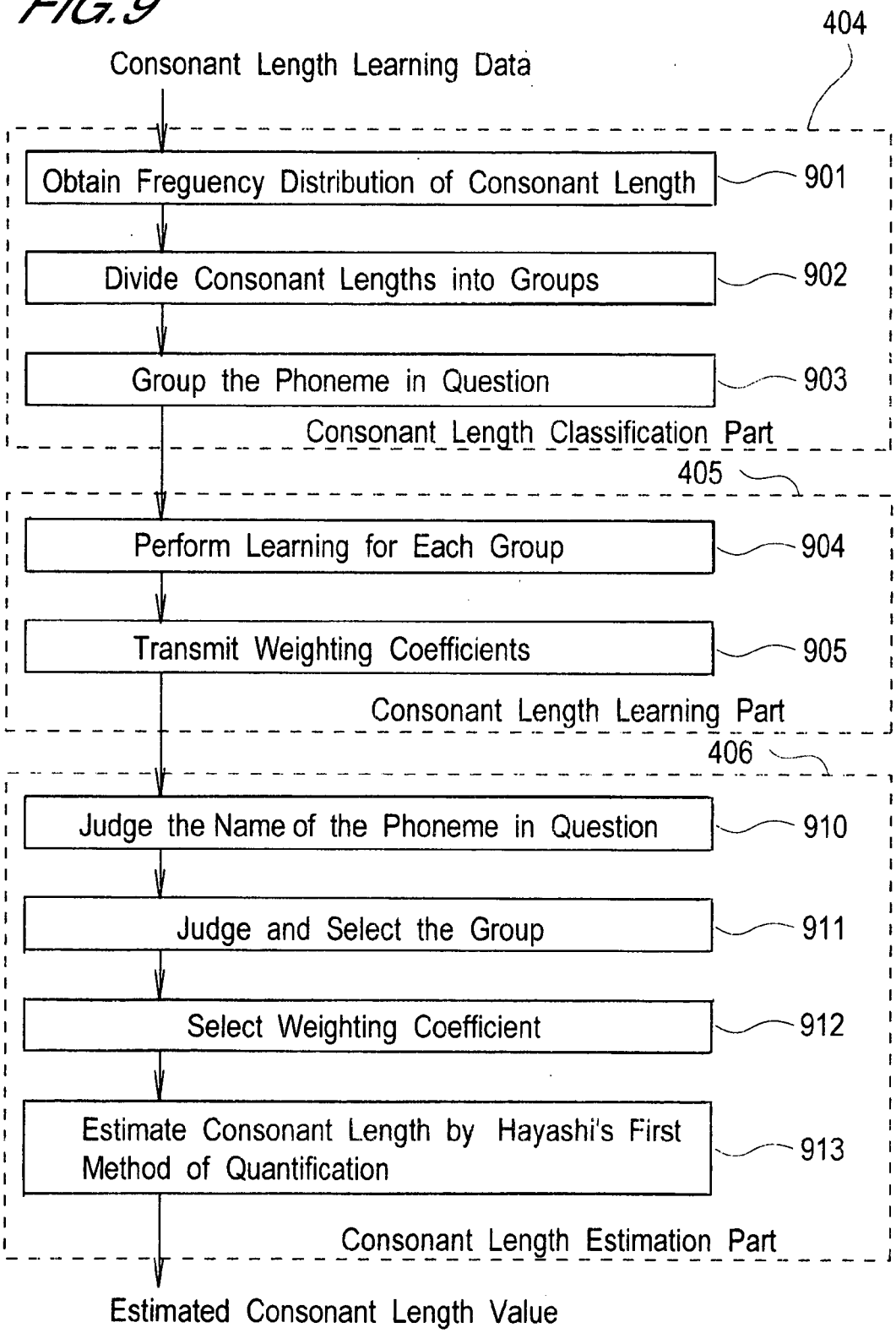
FIG. 9 illustrates the operation of the consonant length classification part, the consonant length learning part and the consonant length estimation part in the third embodiment of this invention.

The characterizing features of the third embodiment are vowel length classification part 401, vowel length learning part 402 and vowel length estimation part 403, whose operation is illustrated in FIG. 8, and consonant length classification part 404, consonant length learning part 405 and consonant length estimation part 406, whose operation is illustrated in FIG. 9.

In relation to the vowel length, the frequency distribution of an external criterion (vowel length) in the learning data is determined at step 801 in FIG. 8. At step 802, based on the frequency distribution, the vowel length is divided into some groups. Furthermore, at step 803 the correspondence with the phoneme in question is obtained, and this phoneme is also divided into groups. In vowel length learning part 402, learning is performed for each of the abovementioned groups at step 804 and the weighting coefficients are determined, and as a result the weighting coefficients are transmitted to vowel length estimation part 403 at step 805.

When estimation is performed in vowel length estimation part 403, the name of the phoneme in question is judged from the input phoneme symbol sequence at step 810, said group is selected from the phoneme name in question at step 811, the weighting coefficients inherent to said group are selected at step 812, and said weighting coefficients are used to estimate the vowel length by Hayashi's first method of quantification at step 813.

Similarly, in relation to consonants, the frequency distribution of an external criterion (consonant length) in the learning data is determined at step 901 in FIG. 9. At step 902, based on the frequency distribution, the consonant length is divided into some groups. Furthermore, at step 903 the correspondence with the phoneme in question is obtained, and this phoneme is also divided into groups. In consonant length learning part 405, learning is performed for each of the abovementioned groups at step 904 and the weighting coefficients are determined, and as a result the weighting coefficients are transmitted to consonant length estimation part 406 at step 905.

When estimation is performed in consonant length estimation part 406, the name of the phoneme in question is judged based on the input phoneme symbol sequence at step 910, said group is selected based on the phoneme name in question at step 911, the weighting coefficients inherent to said group are selected at step 912, and said weighting coefficients are used to estimate the consonant length by Hayashi's first method of quantification at step 913.

As described above, with the present embodiment, the vowel lengths and consonant lengths do not have simple distributions and generally have multi-peaked distributions. By classifying them into groups as described above, learning can be achieved with learning data that is more precise than in conventional methods and the distribution of estimated values can be kept small in the estimations, because the average values of the estimated values are the average values of said groups, thereby improving the estimation precision.

Fourth Embodiment of Method for Setting the Phoneme Duration Time in the Parameter Generation Part A fourth embodiment of a method for setting the phoneme duration time in parameter generation part 103 will be described in detail with reference to FIG. 5.

Figure 5:
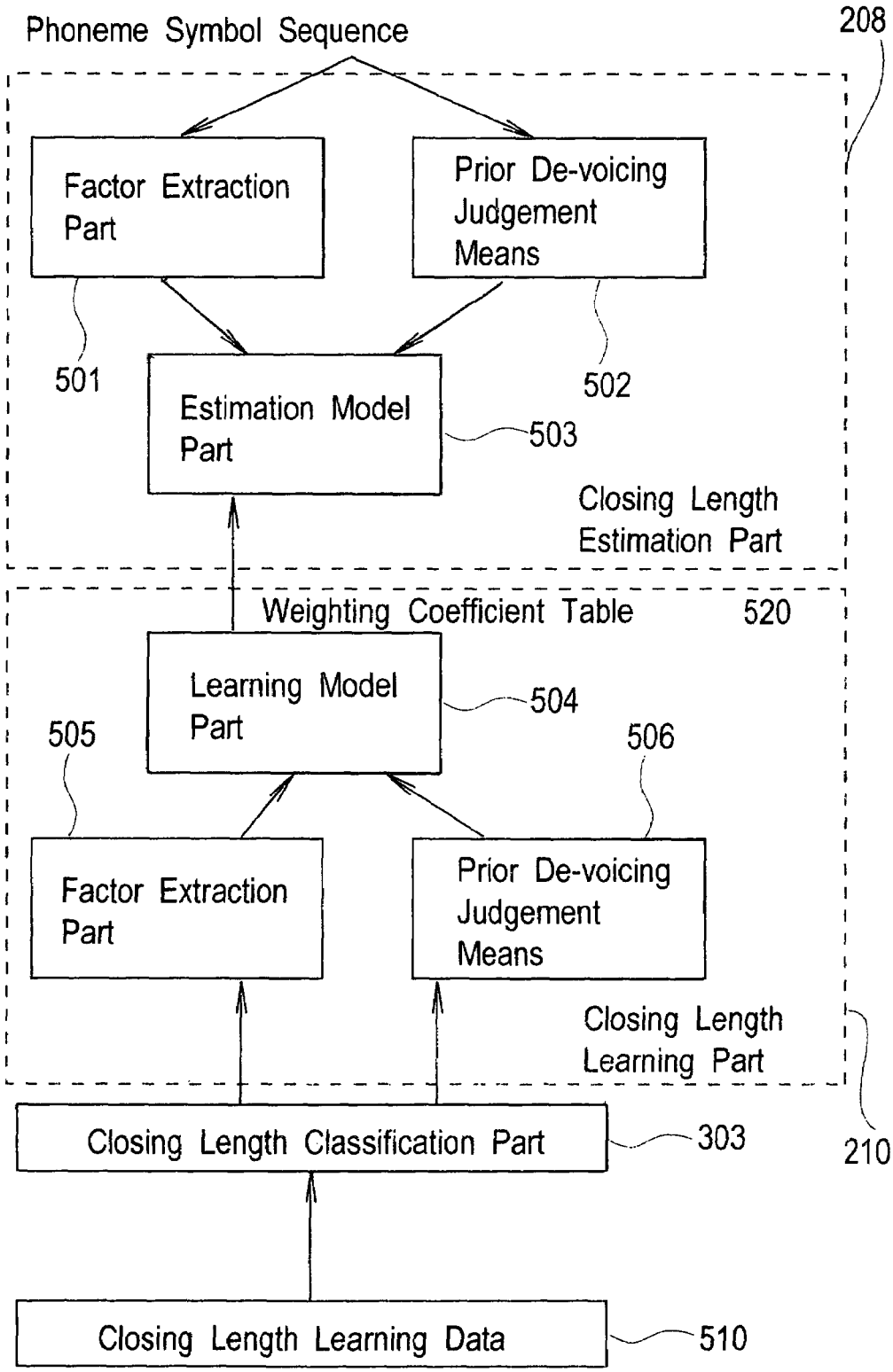
FIG. 5 shows the configuration of the phoneme duration time setting part in a fourth embodiment of this invention.

In FIG. 5, blocks that function in the same way as those in FIG. 2 and FIG. 3 are given the same numbers. In FIG. 5, closing length estimation part 208 comprises a factor extraction part 501, a prior de-voicing judgement means 502 and an estimation model part 503, and closing length learning part 210 consists of a factor extraction part 505, a prior de-voicing judgement means 506 and a learning model part 504. The operation of these parts will be described below.

First, the closing length learning data 510 in the learning data 211 is classified into groups by closing length classification part 303 in the same way as in the second embodiment. After that, factor extraction part 505 extracts factors such as the phoneme name in question, the environment of the two phonemes before and after it, the phoneme position (within a breath group, within a sentence), number of moras (breath group, sentence), part of speech and the like, quantizes these factors, and supplies the results to learning model part 504. At the same time, prior de-voicing judgement means 506 makes a judgement based on the learning data as to whether or not the previous phoneme is de-voiced. Numerical data with a value of 1 is generated if the result of this judgement is that the previous phoneme is to be de-voiced, while numerical data of a value of 2 is generated if it is judged not to be de-voiced, and this numerical data is supplied to learning model part 504. Learning model part 504 is configured to correspond to a model of Hayashi's first method of quantification. This model part 504 then produces a weighting coefficient table 520 for each factor as the learning results for each of said groups, and sends weighting coefficient table 520 to estimation model part 503.

During estimation, in factor extraction part 501, factors that are the same as those in factor extraction part 505 in closing length learning part 210 are extracted from the input phoneme symbol sequence, and these factors are quantized. At the same time, in prior de-voicing judgement means 502, de-voicing of the phoneme is judged by applying the de-voicing rules described below. Numerical data with a value of 1 is generated if the result of this judgement is that the phoneme prior to the phoneme in question is to be de-voiced, while numerical data with a value of 2 is generated if it is judged not to be de-voiced. In estimation model part 503, said group is judged from the phoneme in question, weighting coefficient table 520 is accessed for each group, and the closing length is estimated by a model of Hayashi's first method of quantification.

Here, the de-voicing rules include the following:

(1) An /i/ or /u/ sandwiched between unvoiced consonants is de-voiced.

However, (2) De-voicing is not performed if the phoneme is accentuated.
(3) Consecutive de-voicing is not allowed.
(4) A vowel sandwiched between unvoiced fricatives of the same type is not de-voiced.

These rules are applied by analyzing the input phoneme symbol sequence.

As described above, with the present embodiment, since the closing length is controlled depending on whether or not the preceding phoneme is de-voiced, for example, since /i/ in the syllable /chi/ of /ochikaku/ ("nearby") is de-voiced, it is possible to control the closing interval length that prefixes the /k/ of the following syllable /ka/ to an appropriate value.

Although a configuration is employed wherein the de-voicing rules mentioned below are applied to determine the de-voicing of phonemes in the prior de-voicing judgement means 502 of the fourth embodiment, it is also possible—as an alternative embodiment—to employ a configuration wherein the application of de-voicing rules is performed separately beforehand and predetermined de-voicing information is obtained in closing length estimation part 208.

As described in detail above, since the present invention is a rule-based speech synthesis device that generates arbitrary speech by selecting and concatenating previously stored speech synthesis units and controlling the prosodic information and which is configured by providing it with a phoneme duration time setting means that estimates and controls the closing interval length of phonemes having a closing interval separately for the vowel length and consonant length, it is possible to control the suitable phoneme duration time for phonemes anteriorly having a closing interval, and it is possible to obtain very natural-sounding synthesized speech from a rule-based speech synthesis device.

What is claimed is:

1. A rule-based speech synthesis device which synthesizes arbitrary speech by selecting and concatenating previously stored speech synthesis units and controlling prosodic information, comprising a phoneme duration time setting means which estimates and controls the closing interval length of a phoneme having a closing interval, independently of the vowel length and consonant length, wherein said phoneme duration time setting means comprises:

a phoneme type judgement means that judges the type of a phoneme with respect to the input phoneme symbol sequence, a vowel length determining means comprising a vowel length estimation means and a vowel length learning means, a consonant length determining means comprising a consonant length estimation means and a consonant length learning means, and a closing length determining means comprising a closing length estimation means and a closing length learning means, and wherein said phoneme type judgement means operates said vowel length estimation means or consonant length estimation means depending on whether the phoneme in question is a vowel or a consonant, and if it is judged to be a consonant, it judges whether or not it anteriorly has a closing interval and if it anteriorly has a closing interval then it operates a closing length estimation means.

2. The rule-based speech synthesis device according to claim 1, wherein:

said closing length determining means further comprises a closing length classification means;

said closing length classification means performs classification operations whereby it obtains a frequency distribution of closing lengths from learning data, classifies the closing lengths into a first group based on said frequency distribution and classifies the phoneme in question into a second group based on the first group;

said closing length learning means performs learning operations whereby it is learned with each member of the said second group and outputs weighting coefficients which are necessary for estimation of phoneme duration times to the closing length estimation means; and said closing length estimation means judges the name of the phoneme in question from an input phoneme symbol sequence, judges and selects said second group from said phoneme name, selects weighting coefficients inherent to said group, performs operations to estimate the closing length using said weighting coefficients, and outputs the value of the estimated closing length.

3. The rule-based speech synthesis device according to claim 1, wherein:

said vowel length determining means further comprises a vowel length classification means;

said vowel length classification means performs classification operations whereby it obtains a frequency distribution of vowel lengths from learning data, classifies the vowel lengths into a first group based on said frequency distribution and classifies the phoneme in question into a second group based on the first group;

said vowel length learning means performs learning operations whereby it is learned with each member of the said second group and outputs weighting coefficients which are necessary for estimation of phoneme duration times to the vowel length estimation means; and said vowel length estimation means judges the name of the phoneme in question from an input phoneme symbol sequence, judges and selects said second group from said phoneme name, selects weighting coefficients inherent to said group, performs operations to estimate the vowel length using said weighting coefficients, and outputs the value of the estimated vowel length.

4. The rule-based speech synthesis device according to claim 1, wherein:

said consonant length determining means further comprises a consonant length classification means;

said consonant length classification means performs classification operations whereby it obtains a frequency distribution of consonant lengths from learning data, classifies the consonant lengths into a first group based on said frequency distribution and classifies the phoneme in question into a second group based on the first group;

said consonant length learning means performs learning operations whereby it is learned with each member of the said second group and outputs weighting coefficients which are necessary for estimation of phoneme duration times to the consonant length estimation means; and said consonant length estimation means judges the name of the phoneme in question from an input phoneme symbol sequence, judges and selects said second group from said phoneme name, selects weighting coefficients inherent to said group, performs operations to estimate the consonant length using said weighting coefficients, and outputs the value of the estimated consonant length.

5. The rule-based speech synthesis device according to claim 2, wherein:

said closing length learning means is composed of a first factor extraction means which extracts and quantizes factors comprising the phoneme in question, the phoneme environment consisting of the two phonemes before and after the phoneme in question, the phoneme position, the part of speech and the like, a first prior de-voicing judgement means which judges whether or not the previous phoneme is de-voiced based on the learning data, and a model learning means which produces weighting coefficients for each factor in each of said classified second groups;

and wherein said closing length estimation means is composed of a second factor extraction means which extracts and quantizes factors comprising the phoneme in question, the phoneme environment consisting of the two phonemes before and after the phoneme in question, the phoneme position, the part of speech and the like, a second prior de-voicing judgement means which judges whether or not the phoneme in question is to be de-voiced based on prescribed de-voicing rules, and a model estimation means which judges said second group from the phoneme in question and estimates the closing length by referring to the weighting coefficients output from said model learning means for each group.

* * * * *